United States Patent [19]

Baldini et al.

[11] 4,252,766

[45] Feb. 24, 1981

[54] PROCESS FOR THE PREPARATION OF FORMED BODIES OF REGENERATED CELLULOSE FROM SOLUTIONS OF CELLULOSE DERIVATIVES IN DIMETHYLSULPHOXIDE

[75] Inventors: Alberto Baldini, Garlasco; Roberto Leoni, Milan; Angelo Calloni, Buscate; Gianfranco Angelini, Buscate, all of Italy

[73] Assignee: SNIA VISCOSA Societa Nazionale Industria Applicazioni Viscosa S.p.A., Milan, Italy

[21] Appl. No.: 60,441

[22] Filed: Jul. 25, 1979

[30] Foreign Application Priority Data

Jul. 27, 1978 [IT] Italy ..... 26174 A/78

[51] Int. Cl.[3] ..... C08L 1/08; D01F 2/02

[52] U.S. Cl. ..... 264/187; 106/163 R; 106/168

[58] Field of Search ..... 106/168, 163 R; 264/187

[56] References Cited

U.S. PATENT DOCUMENTS

| | | | |
|---|---|---|---|
| 4,022,631 | 5/1977 | Turbak et al. | 106/108 |
| 4,129,640 | 12/1978 | Rodier | 264/187 |
| 4,173,613 | 11/1979 | Rodier | 264/187 |

*Primary Examiner*—Allan Lieberman

*Attorney, Agent, or Firm*—Ladas & Parry

[57] ABSTRACT

A process for the preparation of formed bodies of regenerated cellulose from cellulose derivative solutions in dimethylsulphoxide is disclosed. The solution is extruded and coagulated in a coagulating bath which is a saline acqueous solution having a substantially non-alkaline or preferably a substantially neutral reaction, a formed body being thus produced.

8 Claims, No Drawings

PROCESS FOR THE PREPARATION OF FORMED BODIES OF REGENERATED CELLULOSE FROM SOLUTIONS OF CELLULOSE DERIVATIVES IN DIMETHYLSULPHOXIDE

FIELD OF THE INVENTION

The present invention refers to a process for the preparation of formed bodies of regenerated cellulose—such as yarns and films—from solutions of cellulose derivatives in an organic solvent.

In particular the solvent considered is dimethylsulphoxide (DMSO) and the cellulose derivatives are reaction products of cellulose and formaldehyde, obtained by dissolving said cellulose in DMSO and paraformaldehyde. Although the precise chemical structure of said derivatives is not certain, they are generally considered as "methylol derivatives" and will be so called in this description.

BACKGROUND OF THE INVENTION

It is known to dissolve the cellulose in systems constituted by organic solvents and other substances which may react with cellulose, and systems of this kind are described in the literature; however they have a purely academic interest since they are not adapted, as far as is known up to now, for carrying out industrial processes.

More recently it has been proposed to use the system constituted by paraformaldehyde or formaldehyde and DMSO. However it is not easy to obtain regenerated cellulose formed bodies from such solutions especially in industrial operation. The most interesting formed bodies are regenerated cellulose filaments and films, which must be prepared through the steps of coagulation, cellulose regeneration and drawing.

In U.S. Pat. No. 4,022,631 a system is described and claimed for coagulating and regenerating the cellulose from said solutions, which consists in employing as coagulating bath an aqueous solution which is alkaline because of the presence of ammonium or amino compounds or alkaline sulphites or thiosulphates, in particular aqueous ammonia. Although said process permits to form regenerated cellulose bodies, still it is not satisfactory both as concerns its industrial practicability and as to the characteristics of the products obtained.

SUMMARY OF THE INVENTION

The Applicant has now surprisingly found, and this is the object of the present invention, that cellulose derivative solutions in DMSO, of the kind described, may be coagulated to produce formed bodies by using as coagulating baths saline aqueous solutions, having a substantially non-alkaline and preferably substantially neutral reaction, of salts which are not comprised among those the use of which has been suggested up to now for such a purpose. The preferred one among said salts is sodium sulphate, but sodium chloride, zinc sulphate, sodium or potassium acetate and others may also be used.

In the coagulating bath the coagulation of the cellulose derivative, which is in the solution, occurs, and the regeneration of the cellulose may also occur to a limited extent. The regeneration however is carried out, at least prevalently, in successive hot aqueous baths at temperatures preferably comprised between 50° and 95° C. In the same bath the coagulated bodies particularly the filaments, are washed and are drawn to the desired degree, which is preferably between 20% and the maximum that can be withstood without breakage, which in most cases is about 70–80%. The concentration of the saline solution may vary between 1% by weight and the maximum solubility of the salt in water at the chosen temperature and in particular may be about 5% by weight. The temperature of the coagulating bath is comprised between 5° and 80° C. and preferably is about 20° C.

To obtain a good coagulation in baths of this kind, however, solutions of cellulose derivatives must be employed having formaldehyde/cellulose molar ratios comprised between 0.5 and 1.5 and preferably about 1. The expression formaldehyde/cellulose ratio means the molar ratio of $CH_2O$ units to anhydroglucosidic units of the cellulose.

For the preparation of the cellulose solutions in the paraformaldehyde/DMSO system, much higher formaldehyde/cellulose ratios are used, for instance in the vicinity of 7 and at any rate not less than 5. The cellulose derivative which forms under these conditions has a chemical structure which is not exactly known, but is generally considered as a methylol derivative and will be thus designated in this description, without the Applicant being thereby bound to any interpretation as to its exact chemical structure. The cellulose methylol derivative solutions in DMSO at high formaldehyde cellulose/cellulose ratio are stable and may be stored for a very long time. However, before the coagulation may be effected, according to the invention, the formaldehyde units content is lowered by any known method, e.g. by degassing the solution, viz. by subjecting it to heating at a reduced pressure, until the $CH_2O$/anhydroglucosidic units ratio (viz. the molar ratio of $CH_2O$ units which can be titrated by the sodium sulphate method to cellulose anhydroglucosidic units) is reduced to the desired value. The temperatures preferred for this operation are comprised between 70° and 100° C. and pressures between 1 and 100 Tor.

By operating according to the invention, regenerated cellulose yarns perfectly adapted for textile uses are easily obtained.

The invention will be better understood from the description of an embodiment thereof, which is illustrative and not limitative.

A cellulose solution in a paraformaldehyde/DMSO system is prepared, by heating in a closed vessel a suspension of 44 grams of Stroem cellulose, 60.8 grams of paraformaldehyde and 630 ml of DMSO at 130° for 3 hours.

The solution may be stored for a period even of months and anyway, at the moment of its use, it is degassed by subjecting it to pressure of about 20 Tor and a temperature of 87° C. until the molar ratio of $CH_2O$ units to cellulose anhydroglucosidic units is about 1. The viscous solution which results contains 5.55% of cellulose having DP 345 and 0.96% of formaldehyde ($CH_2O$/anhydroglucosidic units ratio 0.94), the viscosity at 20° C. is 263 poises.

The solution is now spun in a coagulating bath constituted by a 5% sodium sulphate aqueous solution. The viscose is fed at 35° C. while the coagulating bath is kept at 15° C. The feed takes place at the rate of 8 ml of viscous solution per minute. The collecting speed of the coagulated filaments is 10 mt/1 min. The length of the yarn immersed in the coagulating bath is 60 cm.

Subsequently the coagulated filaments are passed through four regenerating and washing baths, essentially constituted by water, at temperatures of 60°–65-

°-70°-80° respectively concurrently effecting a total drawing of 40%, applying a suitable finish to the filaments.

The yarn thus obtained, suitably dried and wound up, has the following mechanical characteristics:

Count about 4.2 den/filament

Tenacity of the conditioned yarn—2.47 g/den

Tenacity of the humid yarn—0.82 g/den

Elongation at break of the conditioned yarn—9.8%

Elongation at break of the humid yarn—12.5%

Loop tenacity—0.24 g/den

The filaments have indented and irregular cross sections. The DP, measured on the yarn, is 387 and the crystalline form is cellulose II.

The coagulation of the cellulose derivatives occurs prevalently in the coagulating bath, while the regeneration of the cellulose occurs prevalently in the hot water bath.

We claim:

1. A process for the preparation of formed bodies of regenerated cellulose from cellulose methylol derivative solutions in dimethylsulphoxide, which comprises extruding said cellulose derivative solutions having a lowered formaldehyde-cellulose molar ratio between 0.5 and 1.5 in dimethylsulphoxide and coagulating said solution in a coagulating bath constituted by a non-alkaline saline aqueous solution having a concentration of between 1% by weight and the maximum solubility of the salt in water at the temperature of the bath and said bath having a temperature of between 5° and 80° C., whereby a formed body is produced.

2. Process according to claim 1, characterized in that the coagulating bath has a substantially neutral reaction.

3. Process according to claim 1, characterized in that the salt the aqueous solution whereof constitutes the coagulating bath, is chosen in the group constituted by sodium sulphate, sodium chloride, zinc sulphate, sodium acetate and potassium acetate.

4. Process according to claim 1, characterized in that the concentration of the saline solution is about 5%.

5. Process according to claim 1, characterized in that the extruded and coagulated bodies, prevalently constituted by the cellulose derivative which is present in the starting solution, are subjected to regeneration of the cellulose by treatment with hot water.

6. Process according to claim 5, characterized in that the treatment with hot water occurs in a series of aqueous baths wherein the formed bodies are washed and concurrently drawn.

7. Process according to claim 1, characterized in that the formed bodies are drawn to an overall degree between 20% and the highest degree which can be withstood without breakage.

8. Process according to claim 5, characterized in that the temperature of the regenerating and washing baths is between 50° and 95° C.

* * * * *